US009577371B2

(12) United States Patent
Nishimura et al.

(10) Patent No.: US 9,577,371 B2
(45) Date of Patent: Feb. 21, 2017

(54) CONNECTOR WITH RETAINING PORTION HAVING REINFORCING PORTION

(71) Applicant: Japan Aviation Electronics Industry, Limited, Tokyo (JP)

(72) Inventors: Takayuki Nishimura, Tokyo (JP); Hiroaki Obikane, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 13/872,181

(22) Filed: Apr. 29, 2013

(65) Prior Publication Data

US 2013/0309895 A1 Nov. 21, 2013

(30) Foreign Application Priority Data

May 18, 2012 (JP) ..... 2012-114841

(51) Int. Cl.
*H01R 13/62* (2006.01)
*H01R 12/73* (2011.01)
*H01R 13/627* (2006.01)

(52) U.S. Cl.
CPC ..... *H01R 13/62* (2013.01); *H01R 12/73* (2013.01); *H01R 13/6275* (2013.01)

(58) Field of Classification Search
CPC ..... H01R 13/62; H01R 13/6275; H01R 12/73
USPC ..... 439/74, 345, 327, 328, 374, 377, 573
See application file for complete search history.

(56) References Cited

U.S. PATENT DOCUMENTS 6,986,670 B2 1/2006 Okura et al.
7,112,091 B2 9/2006 Okura et al.
8,272,881 B2 9/2012 Miyazaki et al.
2004/0014335 A1 1/2004 Igarashi et al.
2005/0009383 A1 1/2005 Okura et al.
(Continued)

FOREIGN PATENT DOCUMENTS

CN 1545750 A 11/2004
CN 101847803 A 9/2010
(Continued)

OTHER PUBLICATIONS

English translation of the relevant parts of Japanese Office Action dated Dec. 18, 2013 in Japanese Application No. 2012-114841.
(Continued)

*Primary Examiner* — Felix O Figueroa
*Assistant Examiner* — Paul Baillargeon
(74) *Attorney, Agent, or Firm* — Collard & Roe, P.C.

(57) ABSTRACT

Provided is a connector having a locking mechanism that can ensure both the joining strength between a housing and a locking portion and the locking strength and that can cope with pitch narrowing and miniaturization. A plug connector comprises a plug-side housing, plug-side contacts provided to the plug-side housing and adapted to be electrically connected to a receptacle connector, and plug-side locking portions provided to the plug-side housing and adapted to maintain a connected state of the plug connector and the receptacle connector. The plug-side locking portions each comprise a locking plate having a flat plate-like shape and provided so that the normal direction of the plane of the flat plate is oriented in a locking direction with the receptacle connector, and retaining portions provided to the locking plate and formed so as to be integrated with the plug-side housing.

8 Claims, 13 Drawing Sheets

(56) References Cited

U.S. PATENT DOCUMENTS

| | | | |
|---|---|---|---|
| 2006/0051988 | A1 | 3/2006 | Okura et al. |
| 2010/0248520 | A1 | 9/2010 | Miyazaki et al. |
| 2012/0231637 | A1 | 9/2012 | Takeuchi et al. |

FOREIGN PATENT DOCUMENTS

| | | | |
|---|---|---|---|
| JP | 2004-055306 | A | 2/2004 |
| JP | 2004-055464 | | 2/2004 |
| JP | 2008-053119 | | 3/2008 |
| JP | 2009-259675 | | 11/2009 |
| JP | 2010-225401 | A | 10/2010 |
| JP | 2011-060507 | A | 3/2011 |
| JP | 2011-060650 | A | 3/2011 |
| JP | 2011-065861 | A | 3/2011 |
| WO | 2011/031715 | A2 | 3/2011 |
| WO | 2011032106 | A1 | 3/2011 |

OTHER PUBLICATIONS

Japanese Office Action dated Jul. 3, 2013 in Japanese Application 2012-114841, with English translation of relevant parts.
Chinese Office Action in 2013101749200, dated Mar. 2, 2015, with English translation of relevant parts.

CONNECTOR WITH RETAINING PORTION HAVING REINFORCING PORTION

This application is based upon and claims the benefit of priority from Japanese patent application No. 2012-114841, filed on May 18, 2012, the disclosure of which is incorporated herein in its entirety by reference.

BACKGROUND OF THE INVENTION

This invention relates to a connector.

As a connector for connecting surfaces of boards to each other, a board connector (board-to-board connector) has conventionally been used.

The board connector comprises a pair of a plug connector and a receptacle connector. The plug connector is inserted into the receptacle connector so that contact members of the connectors are brought into contact with each other, thereby establishing electrical connection therebetween.

The plug connector and the receptacle connector each comprise an insulating housing and conductive contact members held by the housing. In addition, the plug connector and the receptacle connector may comprise a locking mechanism for the purpose of reinforcing the housings and maintaining (locking) the connected state of the connectors.

Generally, this locking mechanism is configured such that one of the connectors comprises a locking hook portion while the other connector has a recess for engagement with the hook portion and that locking is achieved by inserting the hook portion into the recess.

For example, as shown in FIG. 26, in JP-A-2009-259675 (Patent Document 1), a plate-like reinforcing metal fitting 4 is fixed to a connector housing 2 of a plug connector and, by inserting hook-shaped engaging portions 42 of the reinforcing metal fitting 4 into recessed engaging portions 81 of reinforcing metal fittings 8 which are fixed to a connector housing 6 of a receptacle connector, the reinforcing metal fitting 4 and the reinforcing metal fittings 8 are fixed together.

In Patent Document 1, the reinforcing metal fitting 4 is fixed to the connector housing 2 by press-fitting a fixing portion 40 of the reinforcing metal fitting 4 into the connector housing 2 so that an end face of the reinforcing metal fitting 4 is oriented in a locking direction.

In JP-A-2004-55464 (Patent Document 2), a plate-like locking portion is fixed to a housing by insert-molding a part of the locking portion into the housing so that an end face of the locking portion is oriented in a locking direction.

In JP-A-2008-53119 (Patent Document 3), a locking metal fitting is fixed to a reinforcing metal fitting by welding.

DISCLOSURE OF THE INVENTION

However, in the structure in which the locking member is press-fitted into the housing as described in Patent Document 1, since a gap is formed between the locking member and the housing, there has been a problem that the mating locking member may enter the gap to damage the housing.

Further, in the structure in which the locking member is press-fitted into the housing with the end face of the locking member being oriented in the locking direction as described in Patent Document 1, since the locking direction and the press-fitting direction are the same, there has been a problem that the joining strength between the locking member and the housing cannot be sufficiently ensured, resulting in a possibility that the locking member may come off the housing unless the locking is completely released when releasing the locking to separate the connectors.

In the method of insert-molding the locking portion so that the end face thereof is oriented in the locking direction as described in Patent Document 2, since it is difficult to make large a locking area of the locking portion, there has been a problem that the amount of locking cannot be sufficiently ensured, resulting in that the locking may be easily released.

Further, there has been a problem that the fixing method by welding as described in Patent Document 3 is difficult to apply to a current board connector with narrowing pitch and increasing miniaturization.

This invention has been made in view of the above-mentioned problems and it is an object of this invention to provide a connector comprising a locking mechanism that can ensure both the joining strength between a housing and a locking portion and the locking strength and that can cope with pitch narrowing and miniaturization.

In order to achieve the above-mentioned object, according to an exemplary aspect of this invention, there is provided a connector comprising a housing, a contact provided to the housing and adapted to be electrically connected to another connector; and a locking portion provided to the housing and adapted to maintain a connected state with the another connector, wherein the locking portion comprises, a locking plate having a shape like a flat plate and provided so that a normal direction of a plane of the flat plate is oriented in a locking direction with the another connector and a retaining portion provided to the locking plate and formed so as to be integrated with the housing.

In this aspect, it is preferable that the connector further comprises a groove portion which is provided to the housing and which is open at least at an upper surface thereof and partially at a side surface thereof, wherein the locking portion is provided so that the locking plate is located at the upper surface of the groove portion, and wherein the retaining portion comprises a pair of members provided at opposite side portions of the locking plate and insert-molded into the housing.

Further, it is preferable that the retaining portion comprises a reinforcing portion formed in a direction crossing the locking direction. In this case, it is preferable that the reinforcing portion has a shape protruding from the open side surface of the groove portion toward a surface facing the open side surface. In addition, the reinforcing portion may have a concave or convex shape.

Still further, it is preferable that an end face, on the open side surface side of the groove portion, of the locking plate comprises a chamfered portion at least on a front surface side of the locking plate.

Still further, it is preferable that the locking portion comprises a terminal portion for connecting the locking portion to a connection object. In this case, it is preferable that the terminal portion comprises an intermediate portion provided to the locking plate and a front end portion provided at an end of the intermediate portion and adapted to be connected to the connection object, and wherein the intermediate portion is insert-molded into the housing.

In addition, the terminal portion may be provided to the locking plate through the retaining portion.

Further, the connection object is a board or a flexible printed circuit (FPC) for example.

According to this invention, it is possible to provide a connector comprising a locking mechanism that can ensure both the joining strength between a housing and a locking portion and the locking strength and that can cope with pitch narrowing and miniaturization.

MODE FOR CARRYING OUT THE INVENTION

Hereinbelow, preferred embodiments of this invention will be described in detail with reference to the drawings.

First, referring to FIGS. 1 to 8, a connector unit 100 and connectors forming the connector unit 100 according to a first embodiment of this invention will be briefly described.

Herein, the connector unit 100 is exemplified by the combination of a plug connector 1 and a receptacle connector 3 of a board connector.

Figure 1:
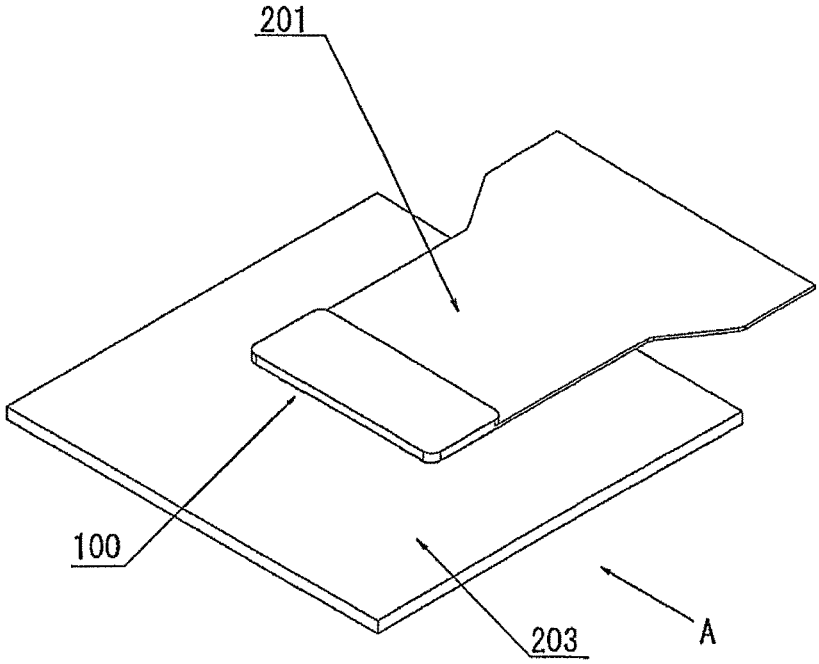
FIG. 1 is a diagram showing a state where a flexible printed circuit 201 and a rigid board 203 are connected together using a connector unit 100 according to a first embodiment of this invention.
Figure 2:
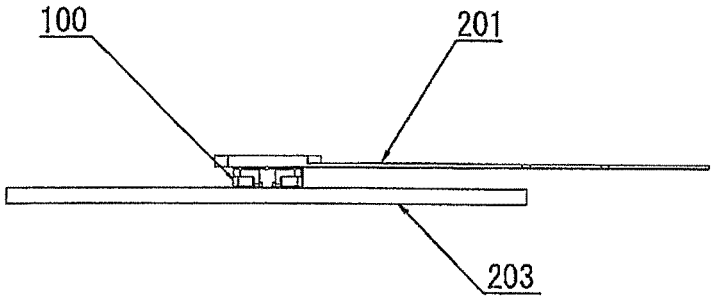
FIG. 2 is a view on arrow A (side view) of FIG. 1.
Figure 3:
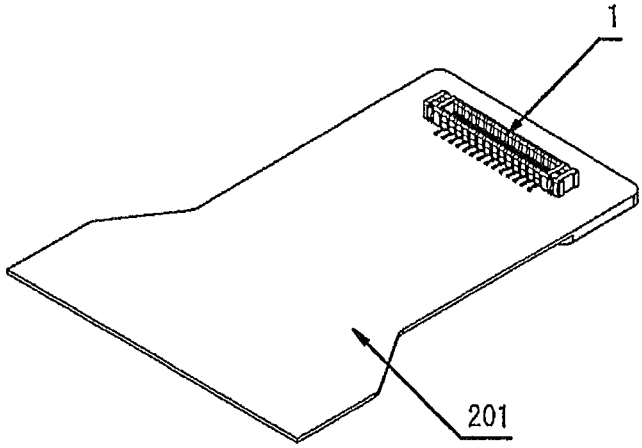
FIG. 3 is a perspective view showing the flexible printed circuit 201 of FIG. 1.
Figure 4:
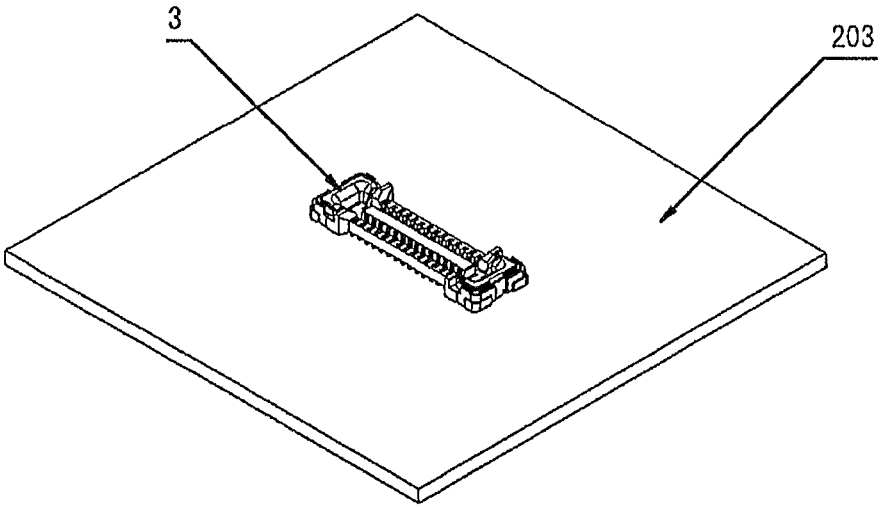
FIG. 4 is a perspective view showing the rigid board 203 of FIG. 1.

As shown in FIGS. 1 and 2, the connector unit 100 is a board connector for connecting together a flexible printed circuit (FPC) 201 and a rigid board 203, for example. In this example, as shown in FIGS. 3 and 4, the connector unit 100 comprises the plug connector 1 which is a connector provided on the flexible printed circuit 201, and the receptacle connector 3 which is another connector provided on the rigid board 203 and adapted to be connected to the plug connector 1.

Figure 5:
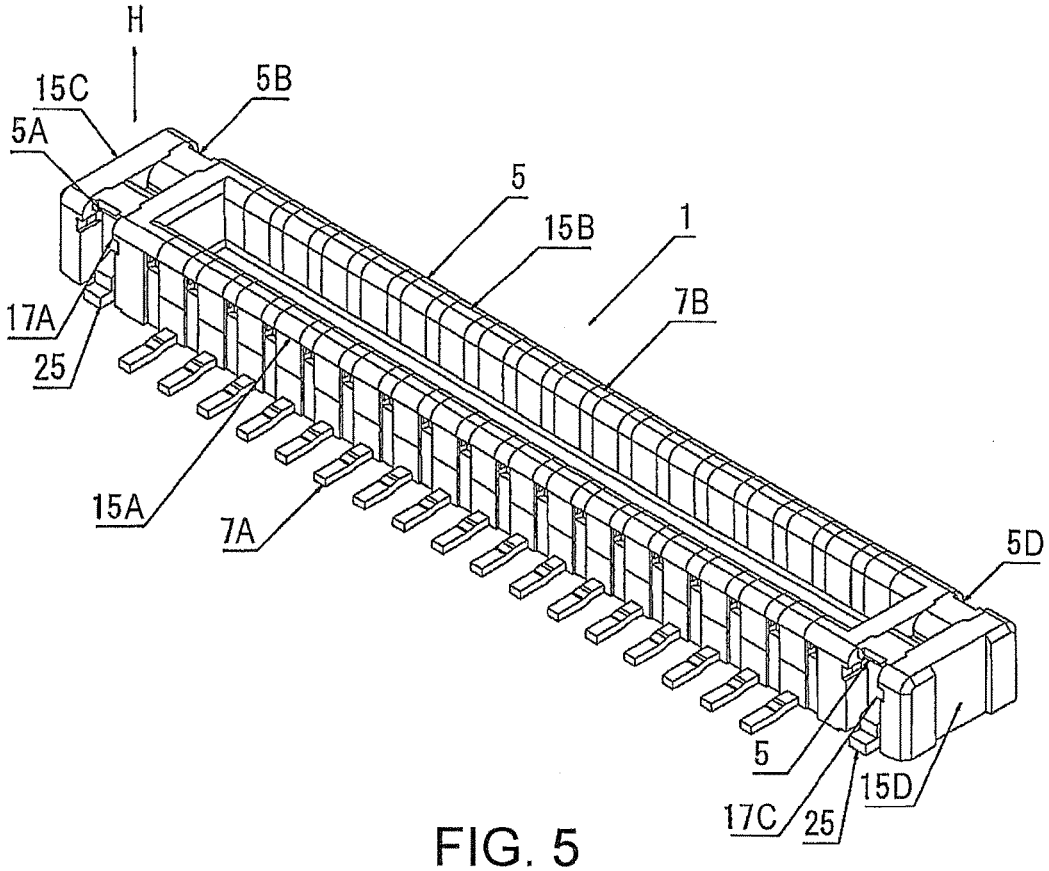
FIG. 5 is a perspective view showing a plug connector 1.
Figure 6:
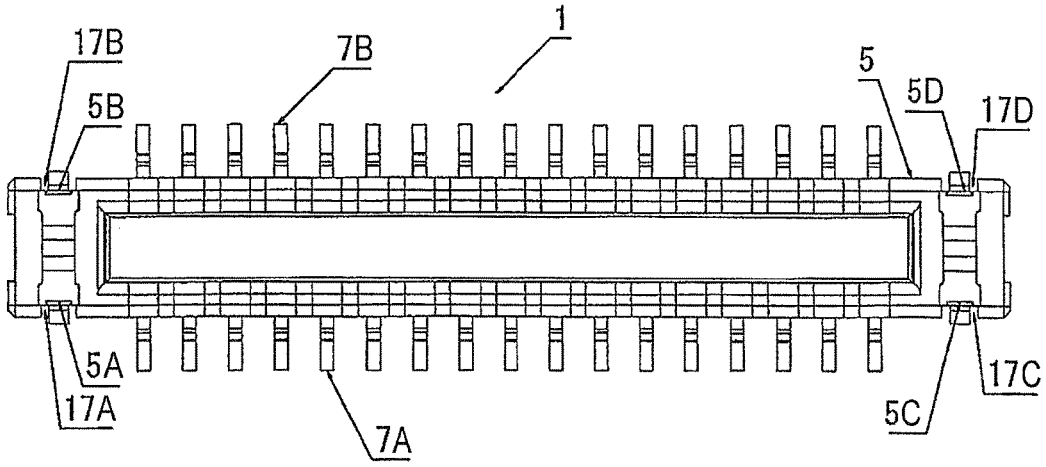
FIG. 6 is a plan view (top view) of FIG. 5.

As shown in FIGS. 5 and 6, the plug connector 1 comprises a plug-side housing 5 having a rectangular shape in plan view, plug-side contacts 7A and 7B arranged at a predetermined pitch in a longitudinal direction of the plug-side housing 5, and plug-side locking portions 5A, 5B, 5C, and 5D provided at four corners of the plug-side housing 5 and adapted to maintain a connected state of the plug connector 1 and the receptacle connector 3.

Figure 7:
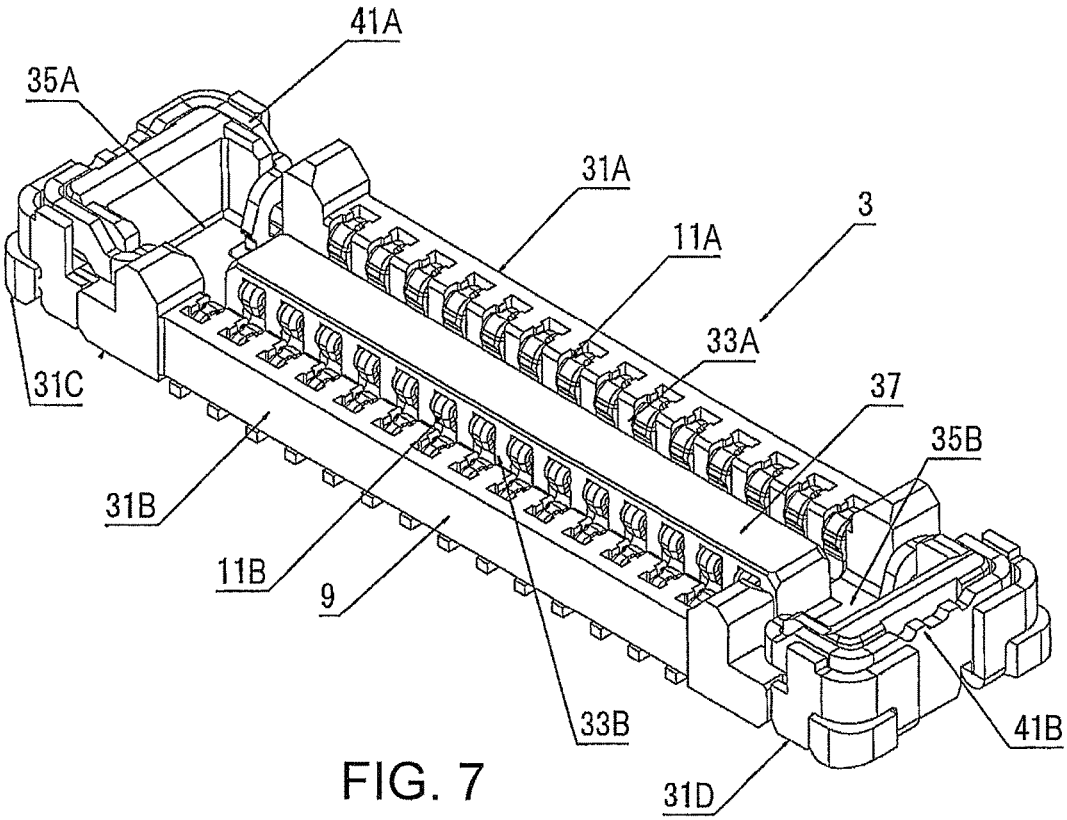
FIG. 7 is a perspective view showing a receptacle connector 3.
Figure 8:
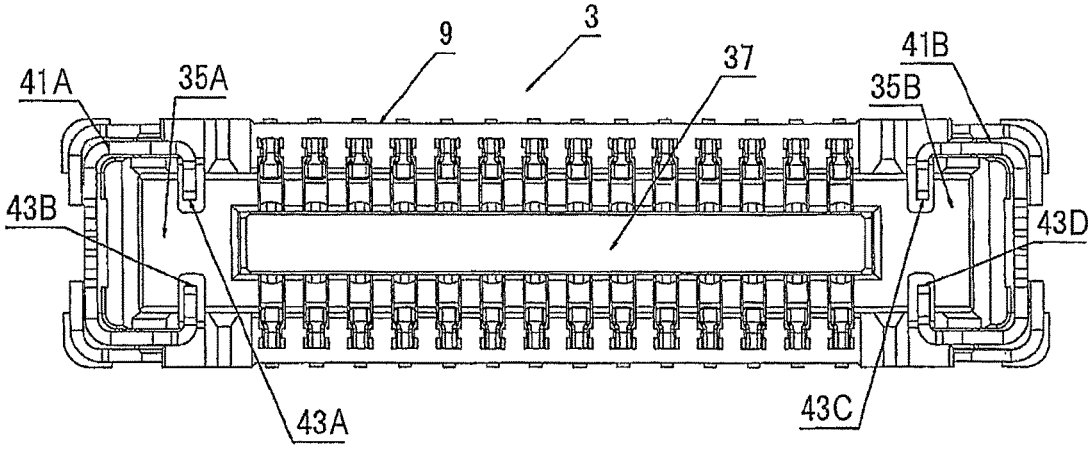
FIG. 8 is a plan view (top view) of FIG. 7.
Figure 9:
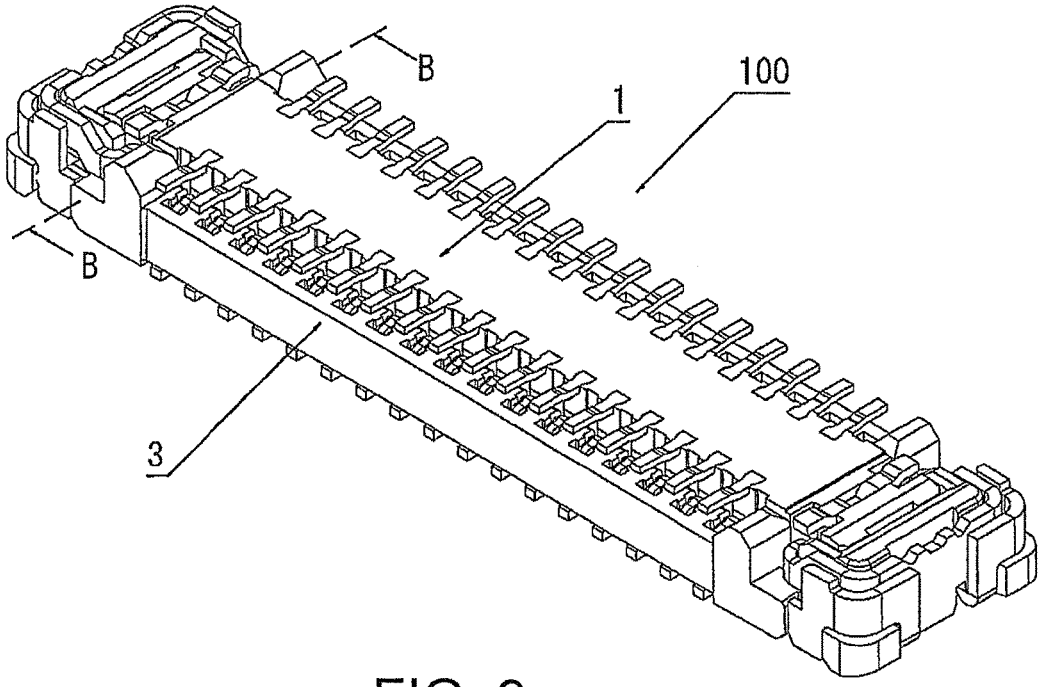
FIG. 9 is a perspective view showing a state where the plug connector 1 and the receptacle connector 3 are joined together.

As shown in FIGS. 7 and 8, the receptacle connector 3 comprises a thick plate-like receptacle-side housing 9 having a rectangular shape in plan view, receptacle-side contacts 11A and 11B held by the receptacle-side housing 9 and adapted to be connected to the plug-side contacts 7A and 7B, and a pair of receptacle-side locking portions 41A and 41B provided at both ends in a longitudinal direction of the receptacle-side housing 9 and adapted to engage with the plug-side locking portions 5A, 5B, 5C, and 5D at the time of locking.

Next, the structure of the plug connector 1 will be described in more detail with reference to FIGS. 5, 6, and 9 to 14.

As shown in FIGS. 5 and 6, the plug-side housing 5 of the plug connector 1 comprises a pair of elongated plate-like mating-side fitting portions 15A and 15B arranged parallel to each other and connecting portions 15C and 15D respectively connecting between end portions of the mating-side fitting portions 15A and 15B. The mating-side fitting portions 15A and 15B and the connecting portions 15C and 15D form a hollow rectangular shape in plan view. In FIGS. 5 and 6, the mating-side fitting portions 15A and 15B correspond to long sides of the rectangular shape while the connecting portions 15C and 15D correspond to short sides of the rectangular shape.

As shown in FIGS. 5, 6, 9, and 10, the plug-side housing 5 comprises groove portions 17A, 17B, 17C, and 17D which are formed at the connecting portions 15C and 15D and which are open at upper surfaces thereof and partially at side surfaces thereof. The plug-side locking portions 5A, 5B, 5C, and 5D are respectively provided at the upper surfaces of the groove portions 17A, 17B, 17C, and 17D.

Herein, both outer ends of each of the mating-side fitting portions 15A and 15B are partially open so that the groove portions 17A, 17B, 17C, and 17D are formed.

As shown in FIGS. 11 to 14, the plug-side locking portion 5A comprises a flat plate-like locking plate 19 provided at the upper surface of the groove portion 17A and a pair of retaining portions 21A and 21B extending from the locking plate 19 and formed so as to be integrated with the plug-side housing 5.

The locking plate 19 is provided in the plug-side housing 5 so that the normal direction of the plane of the flat plate is oriented in a locking direction H of the plug connector 1 and the receptacle connector 3.

On the other hand, the retaining portions 21A and 21B each have a plate-like shape and are bent downward from opposite side end faces (opposite side portions) of the locking plate 19.

The plug-side locking portion 5A further comprises locking plate reinforcing portions 23A and 23B extending from inner end faces, with respect to the plug-side housing 5, of the retaining portions 21A and 21B in a direction (direction I in FIG. 11) crossing the locking direction H. That is, the locking plate reinforcing portions 23A and 23B are each provided so as to protrude from the open side surface of the groove portions 17A, 17B, 17C, and 17D toward a surface facing the open side surface. The retaining portion 21A, 21B and the locking plate reinforcing portion 23A, 23B form a generally L-shape. It is sufficient if either one of the locking plate reinforcing portions 23A and 23B is formed, i.e. it is not necessary to form both.

The plug-side locking portion 5A further comprises a terminal portion 25 for connecting the locking plate 19 to the flexible printed circuit 201 as a connection object. The terminal portion 25 is bent downward from a rear end face, i.e. an inner end face with respect to the plug-side housing 5, of the locking plate 19 and comprises a plate-like intermediate portion 27 insert-molded into the plug-side housing 5 and a plate-like front end portion 29 bent from an end face of the intermediate portion 27 so as to face the locking plate 19 and adapted to be connected to the flexible printed circuit 201 by soldering or the like (see FIG. 14). In this manner, since the plug-side locking portion 5A is insert-molded on the three sides of the locking plate 19, the joining strength between the housing and the locking portion and the locking strength further increase.

Figure 13:
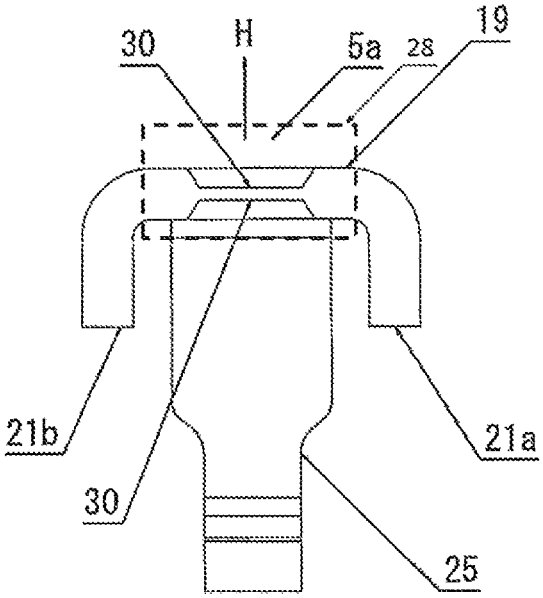
FIG. 13 is a front view showing the plug-side locking portion 5A.
Figure 14:
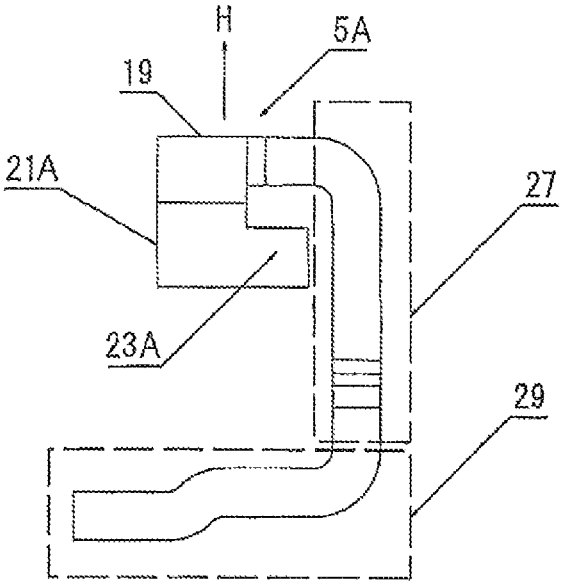
FIG. 14 is a side view showing the plug-side locking portion 5A.

As shown in FIG. 13, an end face, on the open side surface side of the groove portion 17A, of the locking plate 19 is formed with a chamfered portion 30 at least on the front surface side (in FIG. 13, on both front and back surface sides). The end face and the chamfered portion 30 together constitute a locking plate end portion 28.

Since the structures of the plug-side locking portions 5B, 5C, and 5D are the same as that of the plug-side locking portion 5A, description thereof is omitted. While the locking plate reinforcing portions 23A and 23B are provided to the retaining portions 21A and 21B, respectively, only one of them may be provided to the corresponding retaining portion 21A, 21B. In this case, the plug-side locking portions 5A, 5B, 5C, and 5D may have the same shape or different shapes.

Next, the structure of the receptacle connector 3 will be described in more detail with reference to FIGS. 7 to 10.

As shown in FIGS. 7 to 10, the receptacle-side housing 9 of the receptacle connector 3 comprises a pair of first side wall portions 31A and 31B having a longitudinal direction in a pitch direction of the receptacle-side contacts 11A and 11B and facing each other and a pair of second side wall portions 31C and 31D facing each other and respectively connecting between end portions of the first side wall portions 31A and 31B. Herein, the first side wall portions 31A and 31B correspond to long sides of the rectangular shape while the second side wall portions 31C and 31D correspond to short sides of the rectangular shape.

As shown in FIG. 7, on an upper surface of the receptacle-side housing 9, groove portions 33A and 33B into which the mating-side fitting portions 15A and 15B of the plug connector 1 are inserted are formed along the long sides of the rectangular shape, and the receptacle-side contacts 11A and 11B are arranged at a predetermined pitch in the longitudinal direction and lie over the groove portions 33A and 33B.

End portions of the groove portions 33A and 33B are connected together by connecting grooves 35A and 35B formed along the short sides of the rectangular shape and a block-like convex portion 37 is formed at a middle portion between the groove portions 33A and 33B so that the plan-view shape as a whole corresponds to the hollow rectangular shape of the plug-side housing 5 of the plug connector 1.

Further, the plate-like receptacle-side locking portions 41A and 41B are provided in the second side wall portions 31C and 31D.

As shown in FIG. 8, the receptacle-side locking portions 41A and 41B are each a plate-like member having a C-shape in plan view and are provided so that both end portions of the C-shape of the receptacle-side locking portions 41A and 41B are exposed to the connecting grooves 35A and 35B.

Figure 10:
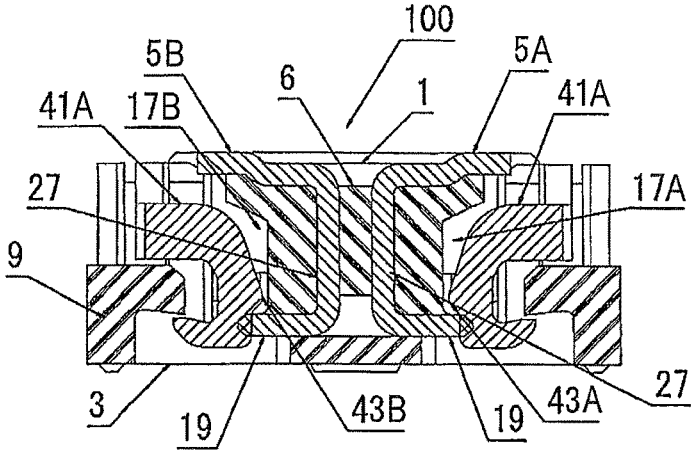
FIG. 10 is a cross-sectional view taken along line B-B of FIG. 9.
Figure 11:
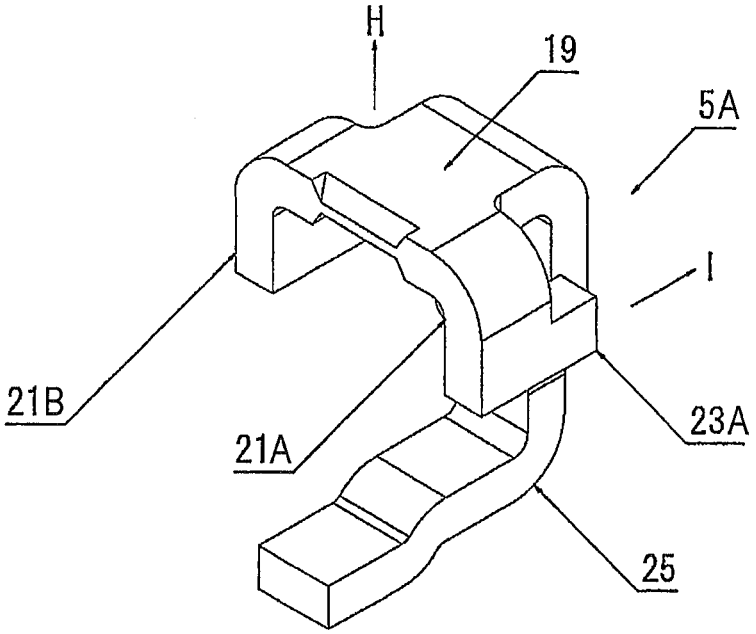
FIG. 11 is a perspective view showing a plug-side locking portion 5A.
Figure 12:
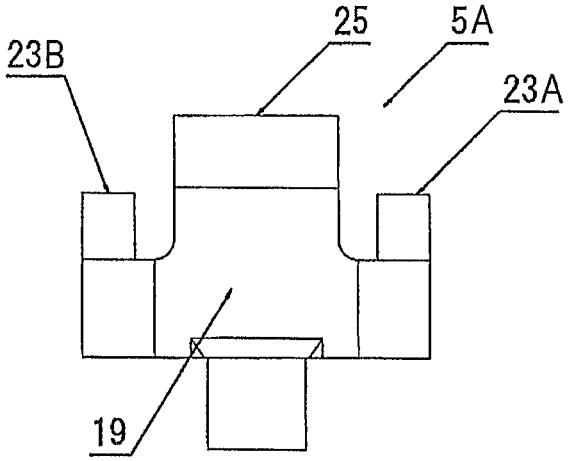
FIG. 12 is a plan view showing the plug-side locking portion 5A.

Both end portions of the C-shape of the plate-like receptacle-side locking portion 41A comprise projections 43A and 43B adapted to engage with the locking plates 19 of the plug-side locking portions 5A and 5B (see FIG. 10). Likewise, both end portions of the C-shape of the plate-like receptacle-side locking portion 41B comprise projections 43C and 43D adapted to engage with the locking plates 19 of the plug-side locking portions 5C and 5D.

The foregoing is the description of the structures of the respective members forming the plug connector 1 and the receptacle connector 3.

Next, processes of joining the plug connector 1 to the receptacle connector 3 in the connector unit 100 will be briefly described with reference to FIGS. 15 to 18.

Figure 15:
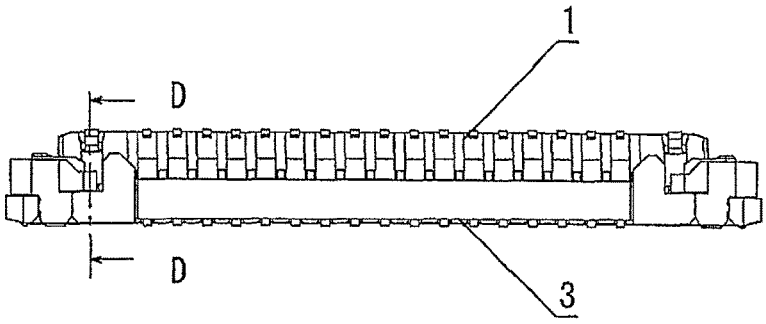
FIG. 15 is a side view showing a process of joining the plug connector 1 to the receptacle connector 3.
Figure 17:
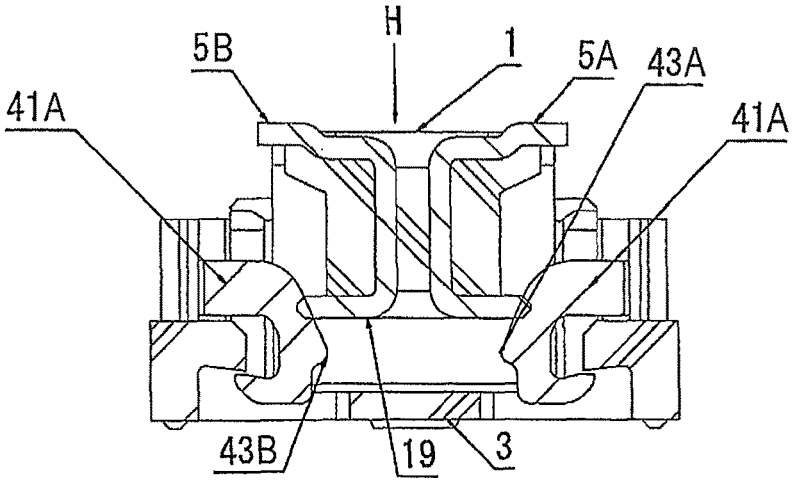
FIG. 17 is a cross-sectional view taken along line D-D of FIG. 15, wherein, however, a receptacle-side locking portion 41A is shown in a state where it is not elastically deformed.

First, as shown in FIGS. 15 and 17, the positions of the groove portions 33A and 33B of the receptacle connector 3 in the plane and the positions of the mating-side fitting portions 15A and 15B of the plug connector 1 in the plane are matched with each other and then the mating-side fitting portions 15A and 15B are inserted into the groove portions 33A and 33B (see FIGS. 5 and 7).

In this event, the locking plates 19 of the plug-side locking portions 5A and 5B and the locking plates 19 of the plug-side locking portions 5C and 5D are brought into contact with both end portions of the C-shape of the receptacle-side locking portions 41A and 41B of the receptacle connector 3, thereby pressing the receptacle-side locking portions 41A and 41B.

Accordingly, while the receptacle-side locking portions 41A and 41B are elastically deformed in a direction in which both end portions of the C-shape are opened, the projections 43A and 43B and the projections 43C and 43D are guided by and ride over the chamfered portions 30 of the locking plates 19 and reach the groove portions 17A and 17B and the groove portions 17C and 17D.

Figure 16:
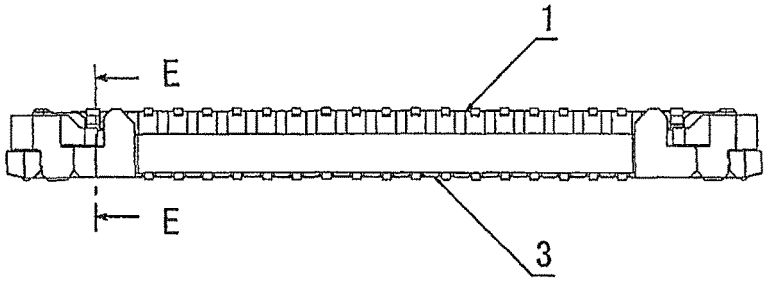
FIG. 16 is a side view showing a process of joining the plug connector 1 to the receptacle connector 3.
Figure 18:
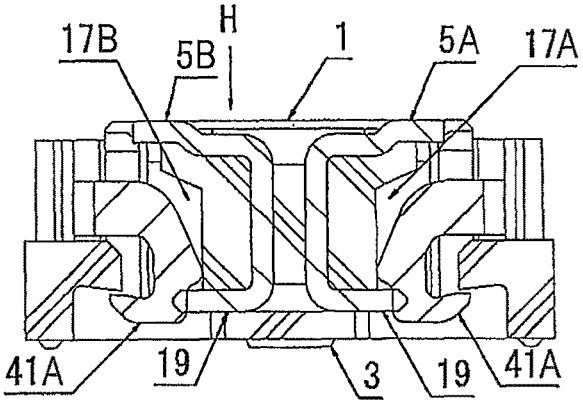
FIG. 18 is a cross-sectional view taken along line E-E of FIG. 16, wherein, however, the receptacle-side locking portion 41A is shown in the state where it is not elastically deformed.

As shown in FIGS. 16 and 18, when the projections 43A and 43B and the projections 43C and 43D have reached the groove portions 17A and 17B and the groove portions 17C and 17D, the receptacle-side locking portions 41A and 41B are elastically deformed in a direction to return to the initial shape (a direction in which both end portions of the C-shape are closed) so that locking is completed.

In this state, the plug-side contacts 7A and 7B of the plug connector 1 are brought into contact with the receptacle-side contacts 11A and 11B of the receptacle connector 3 and thus are electrically connected together.

Herein, since the retaining portions 21A and 21B provided to the locking plates 19 are insert-molded, no gap is formed between the locking plates 19 and the plug-side housing 5.

Consequently, there is no possibility that the receptacle-side locking portions 41A and 41B enter between the locking plates 19 and the plug-side housing 5 to damage the plug-side housing 5 when joining the plug connector 1 to the receptacle connector 3. Further, the joining strength between the retaining portions 21A and 21B and the plug-side housing 5 can also be ensured.

Further, since the locking plate reinforcing portions 23A and 23B are provided to the retaining portions 21A and 21B to cross the locking direction H, it is possible to disperse a force which is applied to each locking plate 19 when joining or releasing the plug connector 1. Consequently, it is possible to prevent deformation of the retaining portions 21A and 21B and thus to further increase the joining strength between the housing and the locking portions.

Further, since each locking plate 19 is provided so that the normal direction of the plane is oriented in the locking direction H, i.e. since the receptacle-side locking portion 41A, 41B is locked in a thickness direction of the locking plate 19, it is possible to increase the amount of engagement (amount of locking) of the locking plate 19 with the receptacle-side locking portion 41A, 41B and thus to increase the locking strength compared to a structure in which an end face is oriented in the locking direction H.

Further, since the retaining portions 21A and 21B provided to the locking plates 19 are insert-molded, joining such as welding is not required separately and therefore it is possible to cope with pitch narrowing and miniaturization of the plug connector 1.

That is, the plug connector 1 is provided with the plug-side locking portions 5A, 5B, 5C, and 5D that can ensure both the joining strength between the plug-side housing 5 and the locking plates 19 and the locking strength and that can cope with the pitch narrowing and miniaturization.

As described above, according to the first embodiment, the plug connector 1 comprises the plug-side housing 5, the plug-side contacts 7A and 7B provided to the plug-side housing 5 and adapted to be electrically connected to the receptacle connector 3, and the plug-side locking portions 5A, 5B, 5C, and 5D provided to the plug-side housing 5 and adapted to maintain a connected state of the plug-side contacts 7A and 7B and the receptacle connector 3. The plug-side locking portions 5A, 5B, 5C, and 5D each comprise the locking plate 19 having the flat plate-like shape and provided so that the normal direction of the plane of the flat plate is oriented in the locking direction H with the receptacle connector 3, and the retaining portions 21A and 21B provided to the locking plate 19 and formed so as to be integrated with the plug-side housing 5.

Consequently, the plug connector 1 can ensure both the joining strength between the plug-side housing 5 and the locking plates 19 and the locking strength and further can cope with the pitch narrowing and miniaturization thereof.

Next, first and second modifications of the first embodiment will be described with reference to FIGS. 19 and 20.

The first and second modifications of the first embodiment differ from the first embodiment in that the locking plate reinforcing portions 23A and 23B are formed as a concave or convex shape on surfaces of the retaining portions 21A and 21B, respectively.

In the first and second modifications of the first embodiment, the same reference symbols are assigned to components having the same functions as in the first embodiment, thereby mainly describing those portions which are different from the first embodiment.

Figure 19:
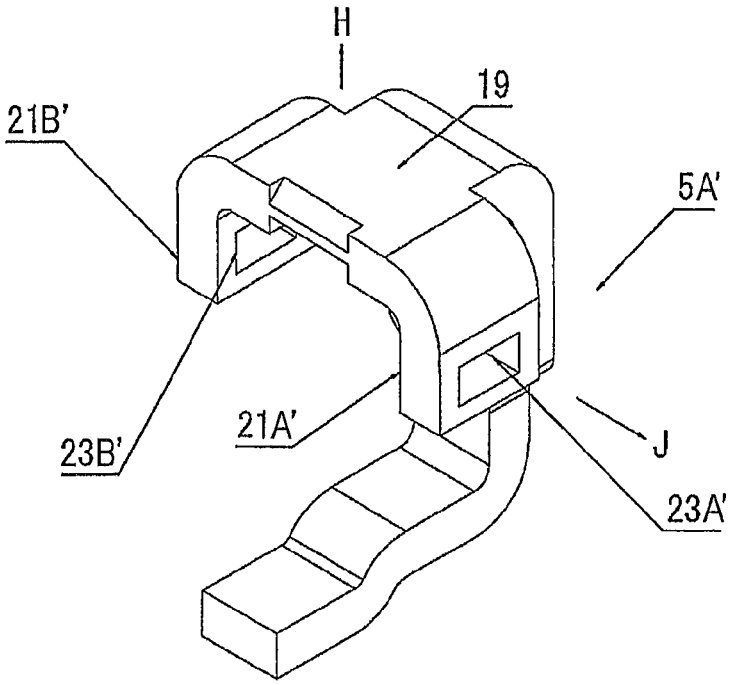
FIG. 19 is a perspective view showing a plug-side locking portion 5A' according to a first modification of the first embodiment.
Figure 20:
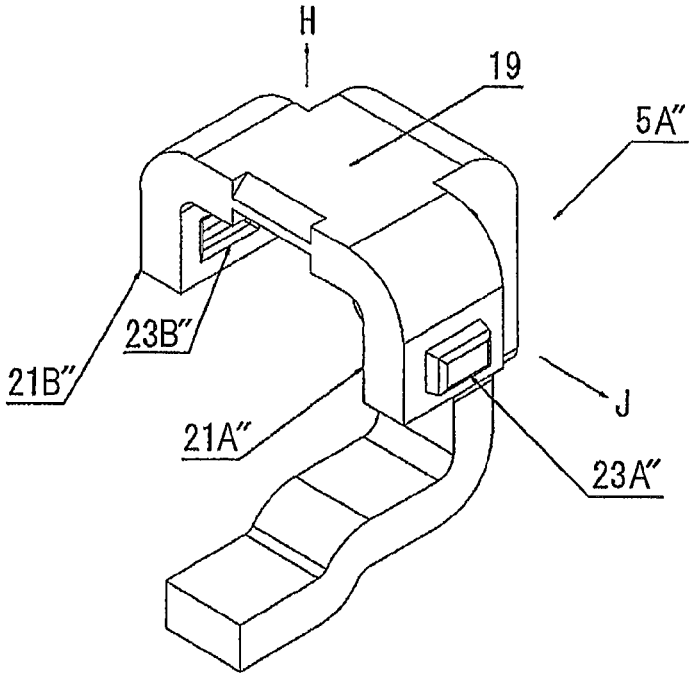
FIG. 20 is a perspective view showing a plug-side locking portion 5A" according to a second modification of the first embodiment.

As shown in FIGS. 19 and 20, in a plug connector 1C (not illustrated) according to the first or second modification of the first embodiment, locking plate reinforcing portions 23A' and 23B', 23A" and 23B" of a plug-side locking portion 5A', 5A" are provided on surfaces of retaining portions 21A' and 21B', 21A" and 21B", i.e. not on end faces thereof, and have a concave shape in FIG. 19 and a convex shape in FIG. 20.

In this manner, as long as the locking plate reinforcing portions 23A' and 23B', 23A" and 23B" are formed in a direction (direction J in FIGS. 19 and 20) crossing the locking direction H, the position thereof is not limited to that in the first embodiment and the shape thereof may be either the concave or convex shape.

Since plug-side locking portions 5B', 5C' and 5D', 5B", 5C" and 5D" are the same in shape as the plug-side locking portion 5A', 5A" and since the structure of a receptacle connector 3 is the same as in the first embodiment, description thereof is omitted.

As described above, according to the first or second modification of the first embodiment, the plug connector 1C comprises the plug-side housing 5, the plug-side contacts 7A and 7B provided to the plug-side housing 5 and adapted to be electrically connected to the receptacle connector 3, and the plug-side locking portions 5A', 5B', 5C' and 5D', 5A", 5B", 5C" and 5D" provided to the plug-side housing 5 and adapted to maintain a connected state of the plug-side contacts 7A and 7B and the receptacle connector 3. The plug-side locking portions 5A', 5B', 5C' and 5D', 5A", 5B", 5C" and 5D" each comprise the locking plate 19 having a flat plate-like shape and provided so that the normal direction of the plane of the flat plate is oriented in the locking direction H with the receptacle connector 3, and the retaining portions 21A' and 21B', 21A" and 21B" provided to the locking plate 19 and formed so as to be integrated with the plug-side housing 5.

Consequently, the same effect as in the first embodiment is obtained.

Next, a second embodiment of this invention will be described with reference to FIGS. 21 and 22.

The second embodiment differs from the first embodiment in that a terminal portion 25A is provided to a locking plate 19 through a retaining portion 21A.

In the second embodiment, the same reference symbols are assigned to components having the same functions as in the first embodiment, thereby mainly describing those portions which are different from the first embodiment.

Figure 21:
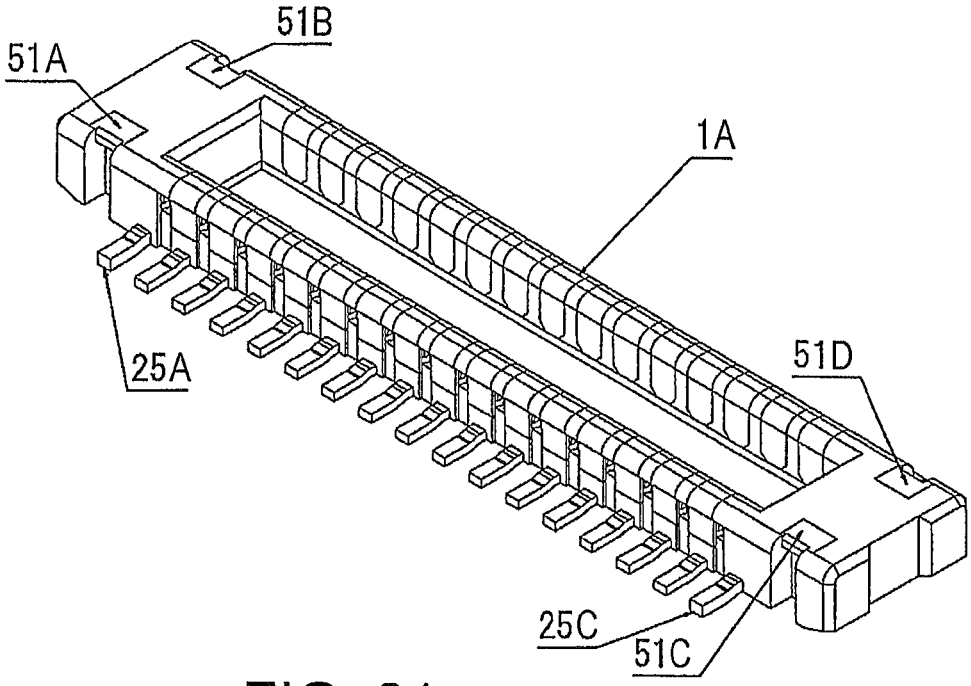
FIG. 21 is a perspective view showing a plug connector 1A according to a second embodiment of this invention.
Figure 22:
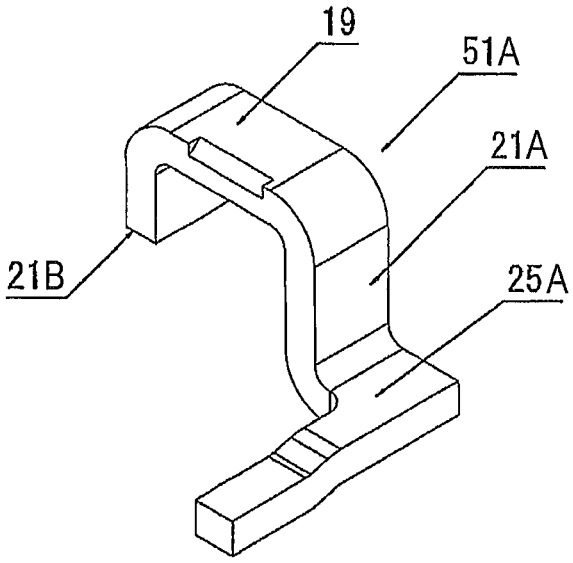
FIG. 22 is a perspective view showing a plug-side locking portion 51A of the plug connector 1A.

As shown in FIGS. 21 and 22, in a plug connector 1A according to the second embodiment, the terminal portion 25A of a plug-side locking portion 51A is not provided directly to the locking plate 19, but is provided to the locking plate 19 through the retaining portion 21A, i.e. one of retaining portions 21A and 21B.

In this manner, the terminal portion 25A is not necessarily provided directly to the locking plate 19.

Since plug-side locking portions 51B, 51C, and 51D are the same in function as the plug-side locking portion 51A and since the structure of a receptacle connector 3 is the same as in the first embodiment, description thereof is omitted. Among the plug-side locking portions 51A, 51B, 51C, and 51D, the plug-side locking portions 51A and 51D have the same shape and the plug-side locking portions 51B and 51C have the same shape. Terminal portions 25A and 25D of the plug-side locking portions 51A and 51D are each provided to the locking plate 19 through a retaining portion 21A while terminal portions 25B and 25C of the plug-side locking portions 51B and 51C are each provided to the locking plate 19 through a retaining portion 21B.

As described above, according to the second embodiment, the plug connector 1A comprises the plug-side housing 5, the plug-side contacts 7A and 7B provided to the plug-side housing 5 and adapted to be electrically connected to the receptacle connector 3, and the plug-side locking portions 51A, 51B, 51C, and 51D provided to the plug-side housing 5 and adapted to maintain a connected state of the plug-side contacts 7A and 7B and the receptacle connector 3. The plug-side locking portions 51A, 51B, 51C, and 51D each comprise the locking plate 19 having a flat plate-like shape and provided so that the normal direction of the plane of the flat plate is oriented in the locking direction H with the receptacle connector 3, and the retaining portions 21A and 21B provided to the locking plate 19 and formed so as to be integrated with the plug-side housing 5.

Consequently, the same effect as in the first embodiment is obtained.

Next, a third embodiment of this invention will be described with reference to FIGS. 23 and 24.

The third embodiment differs from the first embodiment in that the locking plate reinforcing portions 23A and 23B are not provided to the retaining portions 21A and 21B.

In the third embodiment, the same reference symbols are assigned to components having the same functions as in the first embodiment, thereby mainly describing those portions which are different from the first embodiment.

Figure 23:
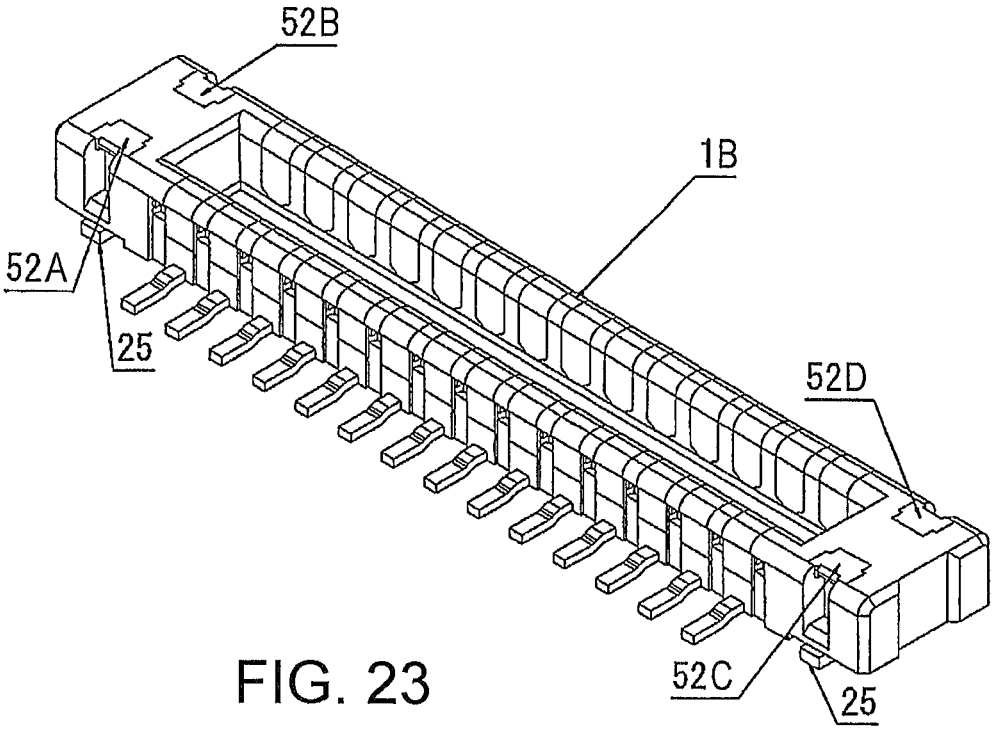
FIG. 23 is a perspective view showing a plug connector 1B according to a third embodiment of this invention.
Figure 24:
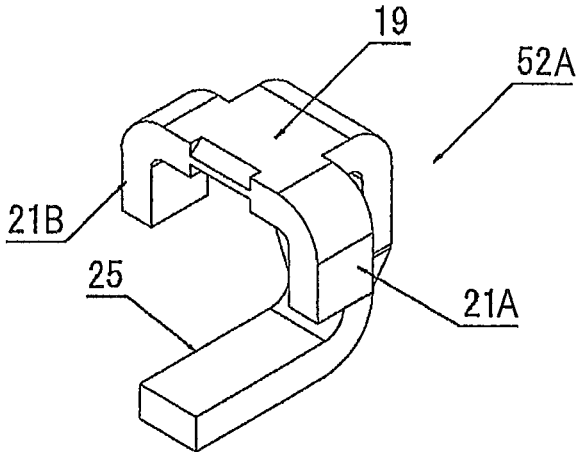
FIG. 24 is a perspective view showing a plug-side locking portion 52A of the plug connector 1B.

As shown in FIGS. 23 and 24, in a plug connector 1B according to the third embodiment, retaining portions 21A and 21B of a plug-side locking portion 52A have no locking plate reinforcing portions 23A and 23B.

In this manner, as long as a locking plate 19 can be securely retained to a plug-side housing 5 only by the retaining portions 21A and 21B and a terminal portion 25, the locking plate reinforcing portions 23A and 23B are not necessarily provided.

Since plug-side locking portions 52B, 52C, and 52D are the same in shape as the plug-side locking portion 52A and since the structure of a receptacle connector 3 is the same as in the first embodiment, description thereof is omitted.

As described above, according to the third embodiment, the plug connector 1B comprises the plug-side housing 5, the plug-side contacts 7A and 7B provided to the plug-side housing 5 and adapted to be electrically connected to the receptacle connector 3, and the plug-side locking portions 52A, 52B, 52C, and 52D provided to the plug-side housing 5 and adapted to maintain a connected state of the plug-side contacts 7A and 7B and the receptacle connector 3. The plug-side locking portions 52A, 52B, 52C, and 52D each comprise the locking plate 19 having a flat plate-like shape and provided so that the normal direction of the plane of the flat plate is oriented in the locking direction H with the receptacle connector 3, and the retaining portions 21A and 21B provided to the locking plate 19 and formed so as to be integrated with the plug-side housing 5.

Consequently, the same effect as in the first embodiment is obtained.

Next, a fourth embodiment of this invention will be described with reference to FIG. 25.

The fourth embodiment differs from the first embodiment in that the locking plate reinforcing portions 23A and 23B and the terminal portion 25 are not provided to the locking plate 19.

In the fourth embodiment, the same reference symbols are assigned to components having the same functions as in the first embodiment, thereby mainly describing those portions which are different from the first embodiment.

Figure 25:
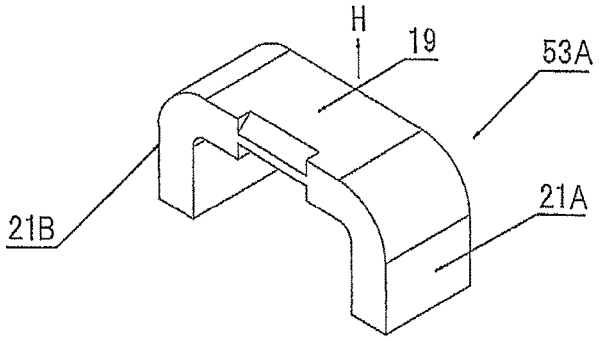
FIG. 25 is a perspective view showing a plug-side locking portion 53A according to a fourth embodiment of this invention.
Figure 26:
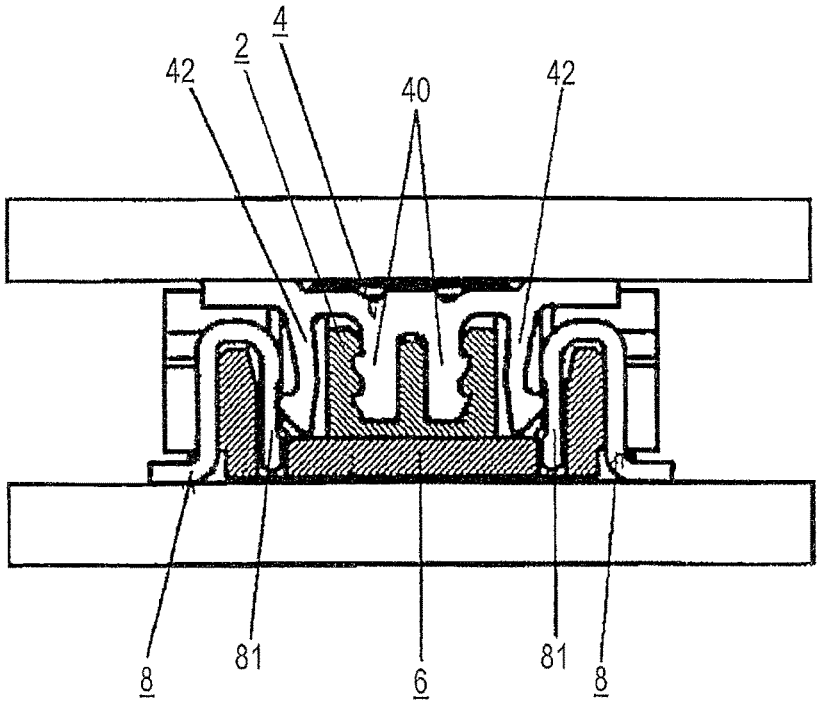
FIG. 26 PRIOR ART
FIG. 26 is a cross-sectional view showing a locking mechanism of a prior art board connector.

As shown in FIG. 25, in a plug connector 1D (not illustrated) according to the fourth embodiment, a locking plate 19 of a plug-side locking portion 53A is provided with no locking plate reinforcing portions 23A and 23B or terminal portion 25, but is provided only with retaining portions 21A and 21B.

In this manner, as long as the locking plate 19 can be securely retained to a plug-side housing 5 only by the retaining portions 21A and 21B, the locking plate reinforcing portions 23A and 23B and the terminal portion 25 are not necessarily provided.

Since plug-side locking portions 53B, 53C, and 53D are the same in shape as the plug-side locking portion 53A and since the structures of the plug-side housing 5 and a receptacle connector 3 are the same as in the first embodiment, description thereof is omitted.

As described above, according to the fourth embodiment, the plug connector 1D comprises the plug-side housing 5, the plug-side contacts 7A and 7B provided to the plug-side housing 5 and adapted to be electrically connected to the receptacle connector 3, and the plug-side locking portions 53A, 53B, 53C, and 53D provided to the plug-side housing 5 and adapted to maintain a connected state of the plug-side contacts 7A and 7B and the receptacle connector 3. The plug-side locking portions 53A, 53B, 53C, and 53D each comprise the locking plate 19 having a flat plate-like shape and provided so that the normal direction of the plane of the flat plate is oriented in the locking direction H with the receptacle connector 3, and the retaining portions 21A and 21B provided to the locking plate 19 and formed so as to be integrated with the plug-side housing 5.

Consequently, the same effect as in the first embodiment is obtained.

In the above-mentioned embodiments, the locking plate 19 has the flat plate-like shape. However, the locking plate 19 may have a curved shape which is convex on the upper or lower surface side.

In the above-mentioned embodiments, the locking portion is retained to the housing by insert-molding the retaining portions 21A and 21B, provided to the locking plate 19, into the housing. However, the locking portion may be retained to the housing by press-fitting the retaining portions 21A and 21B into the housing.

While this invention has been described with reference to the embodiments, this invention is not limited thereto.

It is obvious to those skilled in the art that various changes or improvements can be made within the technical scope of this invention and it is understood that those changes or improvements are also included in the scope of this invention.

What is claimed is:

1. A connector comprising:

a housing;

a contact provided to the housing and adapted to be electrically connected to another connector; and a locking portion provided to the housing and adapted to maintain a connected state with the another connector, wherein the locking portion comprises:

a locking plate having a shape like a flat plate and provided so that a normal direction of a plane of the flat plate is oriented in a locking direction with the another connector; and a retaining portion provided to the locking plate and formed so as to be integrated with the housing;

wherein the housing has a groove portion which is open at least at an upper surface thereof and partially at a side surface thereof, wherein the locking portion is provided so that the locking plate is located at the upper surface of the groove portion, wherein the retaining portion comprises a pair of members provided at opposite side portions of the locking plate and insert-molded into the housing, wherein the retaining portion comprises a reinforcing portion formed in a direction crossing the locking direction, and wherein the reinforcing portion has a shape protruding from the open side surface of the groove portion toward a surface facing the open side surface.

2. The connector according to claim 1, wherein the locking portion comprises a terminal portion for connecting the locking portion to a connection object.

3. The connector according to claim 2, wherein the terminal portion comprises an intermediate portion provided to the locking plate and a front end portion provided at an end of the intermediate portion and adapted to be connected to the connection object, and wherein the intermediate portion is insert-molded into the housing.

4. The connector according to claim 2, wherein the terminal portion is provided to the locking plate through the retaining portion.

5. The connector according to claim 2, wherein the connection object is a board or a flexible printed circuit (FPC).

6. The connector according to claim 1, wherein the reinforcing portion has a concave or convex shape.

7. The connector according to claim 1, wherein the end face, on a side of the open side surface of the groove portion, of the locking plate comprises a chamfered portion at least on a side of the front surface of the locking plate.

8. The connector according to claim 1, wherein the locking plate of the locking portion is provided so that one of the front and the back surfaces of the locking plate locks the another connector in the locking direction, and wherein the locking plate is shaped in a shape of a straight and flat plate devoid of protruding, recess and bending and has front and back surfaces oriented in a direction perpendicular to a locking direction with the another connector.

* * * * *